US012050089B2

(12) United States Patent
Bocini

(10) Patent No.: US 12,050,089 B2
(45) Date of Patent: Jul. 30, 2024

(54) BULLETPROOF PROTECTIVE STRUCTURE

(71) Applicant: INDUSTRIE BITOSSI S.P.A., Sovigliana-Vinci (IT)

(72) Inventor: Loriano Bocini, Montelupo Fiorentino (IT)

(73) Assignee: INDUSTRIE BITOSSI S.P.A., Sovigliana-Vinci (IT)

( * ) Notice: Subject to any disclaimer, the term of this patent is extended or adjusted under 35 U.S.C. 154(b) by 0 days.

(21) Appl. No.: 18/165,497

(22) Filed: Feb. 7, 2023

(65) Prior Publication Data

US 2023/0384061 A1 Nov. 30, 2023

(30) Foreign Application Priority Data

Apr. 11, 2022 (IT) ..... 102022000007115

(51) Int. Cl.
*F41H 5/04* (2006.01)

(52) U.S. Cl.
CPC ..... *F41H 5/0492* (2013.01); *F41H 5/0428* (2013.01); *F41H 5/0457* (2013.01)

(58) Field of Classification Search
CPC ..... F41H 5/0492; F41H 5/0428; F41H 5/0457
USPC ..... 89/36.02
See application file for complete search history.

(56) References Cited

U.S. PATENT DOCUMENTS 5,996,115 A * 12/1999 Mazelsky ..... F41H 1/02 2/2.5
6,170,378 B1 * 1/2001 Neal ..... F41H 5/0492 428/221
8,434,396 B1 * 5/2013 Wiley ..... F41H 5/013 89/36.01
11,884,047 B1 * 1/2024 Adelson ..... B32B 7/022
2003/0167910 A1 * 9/2003 Strait ..... F41H 5/0414 89/36.02
2006/0243127 A1 * 11/2006 Cohen ..... F41H 5/0492 89/36.02
2008/0307553 A1 * 12/2008 Jbeili ..... F41H 5/0471 2/2.5
2010/0005955 A1 * 1/2010 Ohnstad ..... F41H 5/0421 89/36.02
2013/0160639 A1 * 6/2013 Lee ..... F41H 5/013 264/603
2020/0033097 A1 * 1/2020 Speyer ..... B32B 3/04
2023/0228535 A1 * 7/2023 Shackelford ..... F41H 5/023 89/36.02

FOREIGN PATENT DOCUMENTS

EP 1980813 A2 10/2008
EP 3098560 B1 11/2016
(Continued)

OTHER PUBLICATIONS

Italian Search Report and Written Opinion in corresponding Italian Patent Application No. 102022000007115 mailed Nov. 23, 2022. 7 pages.

*Primary Examiner* — Samir Abdosh
(74) *Attorney, Agent, or Firm* — Leason Ellis LLP

(57) ABSTRACT

A bulletproof protective structure (40) is described, composed of a flexible base constituted of a ballistic fabric (42) and of rigid elements (41) of ballistic material adhering to the fabric, wherein the adhesion surface of the rigid elements to the fabric is curved, so as to allow greater flexibility of the structure compared to similar known structures.

19 Claims, 4 Drawing Sheets

(56) References Cited

FOREIGN PATENT DOCUMENTS

| | | | | | |
|---|---|---|---|---|---|
| EP | 3805691 | A1 | | 4/2021 | |
| IL | 1980813 | A2 | * | 3/2008 | ..... F41H 5/04 |
| WO | 9424894 | A1 | | 11/1994 | |
| WO | WO-0229351 | A1 | * | 4/2002 | ..... F41H 5/0428 |
| WO | 2012083395 | A1 | | 6/2012 | |

* cited by examiner

BULLETPROOF PROTECTIVE STRUCTURE

CROSS-REFERENCE TO RELATED PATENT APPLICATIONS

This application claims the benefit of priority of Italian Patent Application No. 102022000007115 filed Apr. 11, 2022, which is incorporated by reference in its entirety.

FIELD OF THE INVENTION

The present invention refers to a bulletproof protective structure, composed of a flexible base constituted by a ballistic fabric and of a panel made of rigid elements of ballistic material adhering to a second layer of ballistic fabric.

More in detail the invention concerns a protective structure suitable for making bulletproof vests or panels capable of guaranteeing high levels of protection, in particular higher than level Ma according to US NIJ regulations.

STATE OF THE ART

Effective bulletproof protections are known to be obtained by means of structures made by combining intertwined or unidirectional fibers capable of absorbing and dispersing the force of impact and penetration of the bullets through plastic deformation (elongation) of the fibers themselves; the fibres most commonly used for this purpose are the aramid fibres generally known by the name "Kevlar®" (registered trademark of E. I. du Pont de Nemours and Company), or the ultra-high molecular weight polyethylene fibers (also known as UHMWPE), in particular the Dyneema® fibers (registered trademark of Royal DSM N.V.).

The number of overlapping layers determines the protection capacity of the structure.

Typically, fiber-only structures can provide effective protection against firearm bullets up to gauge 7.65 9 Parabellum 357 and 44 Magnum. This corresponds to a protection level Ina according to the regulations defined by the US National Institute of Justice (NIJ). These structures are particularly light, usually have an areal density that can vary between 4.5 and 7 kg/m$^2$, are comfortable to wear and with a degree of flexibility that allows large zones of the body to be covered.

However, these structures made of polymer fiber alone are not sufficient for protecting against bullets with gauge greater than those indicated above, for example those fired by long weapons such as 7.62×51 NATO BALL, 7.62×39, AK47 and SS109 NATO. To achieve superior protection, it is necessary to add a series of rigid elements, capable of fragmenting the bullets fired by long weapons into smaller parts that can be more easily stopped by the underlying fiber structure, also thanks to the decrease in their energy. These rigid elements can be adjacent or spaced from each other, and are made of metallic materials or more often with the so-called ballistic ceramics, in particular alumina (aluminum oxide), silicon carbide or boron carbide, able to fragment the bullets and divide them into chips.

These structures, if made with monolithic ceramic elements of relatively large dimensions are, due to their rigidity, limited to the protection of vital organs only. An extension to the entire torso (chest, back and hips) would make them uncomfortable and not wearable. These solutions use rigid supports made of fiber combined with monolithic ceramic plates (approximately 250 mm×300 mm).

To improve the comfort of these structures, one possibility is to adopt flexible configurations, which comprise a non-monolithic ceramic layer, but based on mosaics of small-sized tiles (about 30 mm×30 mm), associated with a support that is also flexible.

A structure of this type is disclosed in patent EP 3098560 B1. In the structure of this document the rigid elements are in the form of short prisms (square-based parallelepipeds or hexagonal prisms are exemplified), adjacent to each other along their lateral surfaces and glued to a ballistic fabric via one of their basal surfaces. This structure has the disadvantage of still presenting a limited flexibility, due to the fact that the elements are glued on the entire surface of contact with the fabric, so that the bending zone is limited only to lines at their edges.

To overcome the problem, patent application EP 3805691 A1 describes a structure consisting of rigid elements glued on a base in ballistic fibers, wherein the rigid elements have a complex shape, with a central raised zone on the basal face destined for gluing with the fibers. Two embodiments of rigid elements of this document are shown schematically in FIGS. 5 and 6; in the two figures, an equal number corresponds to an equal element. In FIG. 5 a first possible rigid element is shown, respectively in a top view in the upper part of the figure and in a side view in the lower part of the figure; this rigid element, A, has a hexagonal plan section, and consists of a main part, 1, with a flat front face 3 and on whose rear face there is a raised part 2, which does not occupy the entire area of said rear face (a part 2 with circular plan section is exemplified, identified by the dashed line in the upper part of the figure), and which has a face 4 destined for gluing with the fibers. FIG. 6 shows a second possible embodiment of the rigid element of the aforementioned application; the rigid element B is analogous to element A, except for the part 5 which differs from the part 1 due to the presence of a recess 6 on the front face 3, identified by a dashed line in the lower part of the figure; this second embodiment is preferable because it lightens the structure. The structures of this document are more flexible than the previous one, because the gluing zones are not adjacent and there is a space between them that allows an easier bending of the structure. The rigid elements of this document however have a complex construction, in particular those of type B (with recess on the front face): in fact, the ballistic ceramic elements are typically produced by techniques of cold pressing of mixtures of ceramic powders and organic binders and subsequent heat treatment that removes the binder and sinters the powders, but with these techniques it is problematic obtaining parts with sharp angles, for example the angle between the rear face of the parts 1 or 5 and the part 2 of the elements described above, and the lines corresponding to these sharp angles are zones of possible fragility for the resulting ceramic body. Furthermore, it is known in ballistics that rigid elements with such sharply angled section profiles have limited mechanical resistance, which forces to further increase their thickness and therefore their weight.

Another problem encountered with the known structures made of rigid ballistic ceramic elements is a decay in the performance on the edge: a bullet impacting the edge of the element, thus also hitting the adjacent element, is more likely to penetrate the structure; currently, to overcome the problem, the thickness of the ceramic elements is sized so as to ensure sufficient mechanical performance at the edges; this results in the thickness used at the center of the element being oversized compared to what is necessary, with a consequent increase in the weight of the final structure.

Aim of the present invention is to realize a bulletproof structure with a degree of flexibility sufficient to ensure full-body coverage with a protection level higher than level Ina of the US NIJ standard, but without the problems of the prior art. In particular, aim of the invention is to provide a bulletproof protective structure with improved performance at the edges of the rigid elements without having to increase their thickness uniformly and therefore the overall weight of the final structure.

SUMMARY OF THE INVENTION

These aims are achieved according to the present invention, which in a first aspect thereof concerns a bulletproof protective structure comprising a flexible base including intertwined or unidirectional ballistic fibers on which rigid metallic or ceramic elements are adhered adjacent to each other, characterized in that the face of said elements adhering to the fibers is convex, the rigid elements adhere to the flexible base only for a fraction of said convex surface, and in a plan view they have a polygonal or pseudo-polygonal shape, such that there are no voids between the sides of two abutting elements.

In a preferred embodiment of the invention, the main faces of said rigid elements are two curved surfaces, one concave and one convex, said rigid elements adhere to the flexible base for a fraction of their convex surface, and the thickness at the edge of the element is between 0.5 and 2 mm greater than the thickness at the center of the element itself.

BRIEF DESCRIPTION OF THE DRAWINGS

The invention will be described in the following with reference to the figures, wherein.

DETAILED DESCRIPTION OF THE INVENTION

Figure 6:
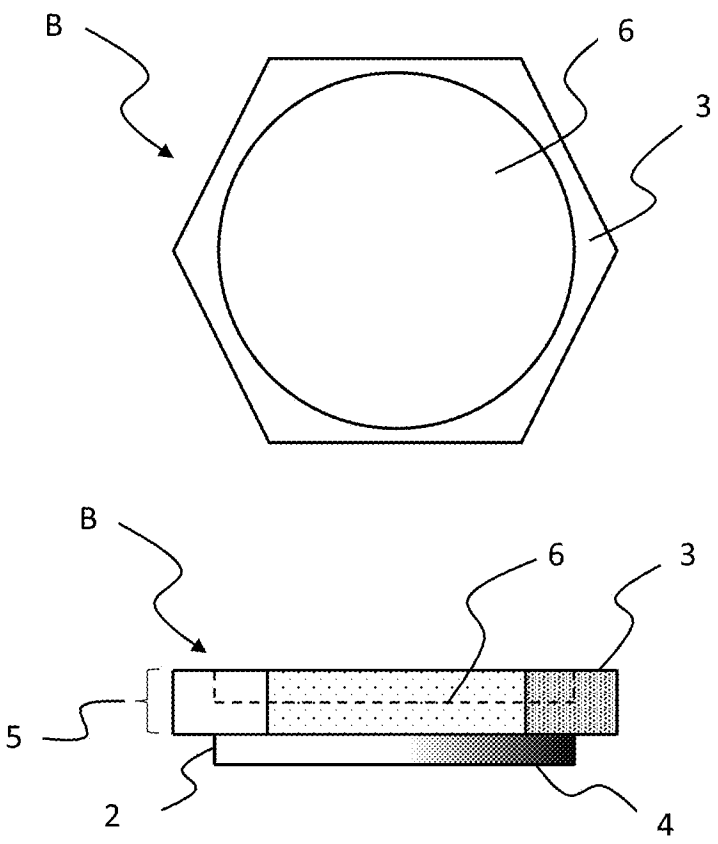
FIGS. 5 and 6 show, in plan and sectional views, rigid elements of bulletproof structures of the prior art.
Figure 5:
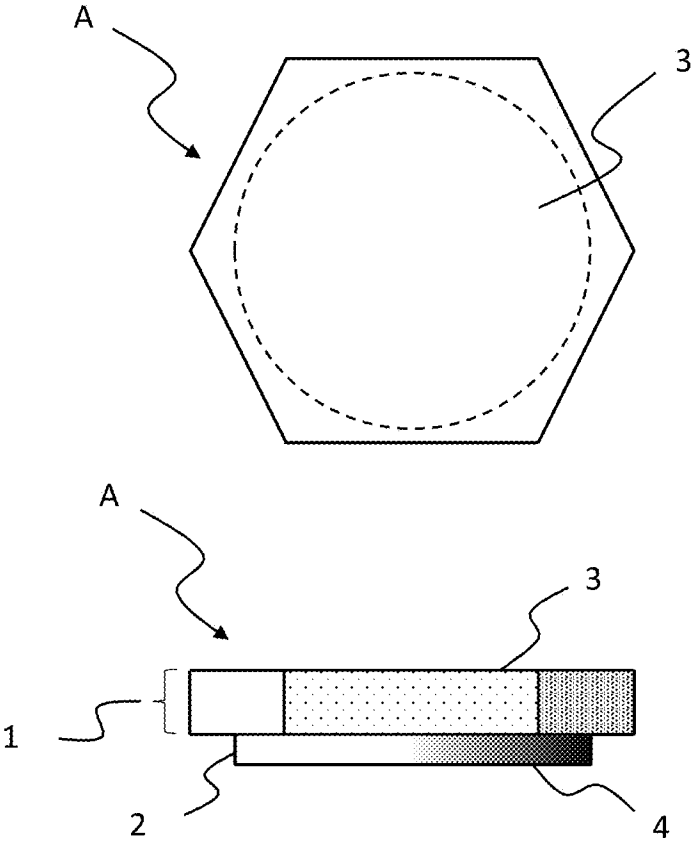

FIGS. 5 and 6 relate to ceramic elements of the prior art, and have already been described above. In the Figures relating to the invention, the dimensions are not necessarily to scale, and some dimensions can be increased to highlight constructional details of the elements and of the structures of the invention; in these Figures, moreover, an equal number corresponds to an equal element.

The bulletproof structure of the invention comprises a flexible base, made of ballistic fibers on which rigid elements are adhered which, unlike those of the known structures, have the surface adhering to the flexible base which has a convex shape and therefore is neither flat nor comprises flat portions.

These rigid elements have two main surfaces, with greater extension, destined the former to stop the bullets and the latter to adhere to the flexible base of polymer fibers, and lateral surfaces with smaller extension that in the overall structure are adjacent to each other.

In the following, the surface destined to stop the bullets will also be defined as the front surface, while the convex one, destined to adhere to the flexible base of polymer fibers, in the following will also be defined as the rear surface.

Figure 1:
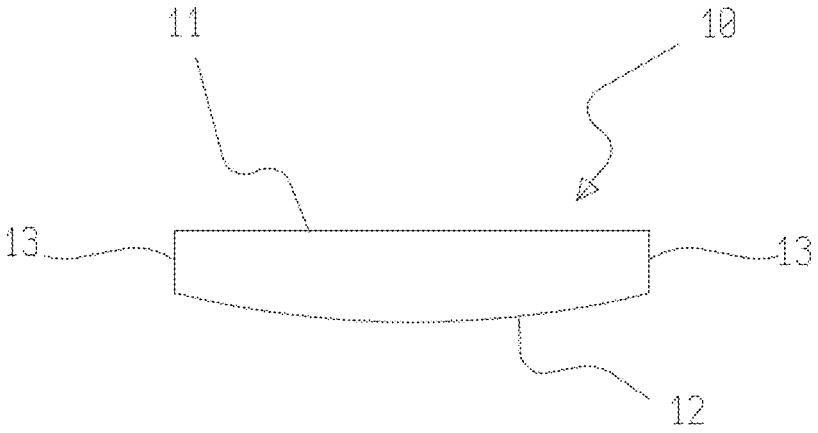
FIG. 1 shows a schematic sectional view of a generic rigid element, in a first embodiment, for the production of a bulletproof structure of the invention.

FIG. 1 shows a schematic sectional view of a generic rigid element for the realization of a bulletproof structure of the invention: the element, 10, comprises a front surface, 11, which has any geometry and is typically flat, and a convex rear surface, 12; the lateral surfaces are indicated in the figure as surfaces 13; the radius of curvature of the convex surface, 12, is between 40 and 350 mm, preferably between 80 and 250 mm and even more preferably between 100 and 180 mm.

Figure 2:
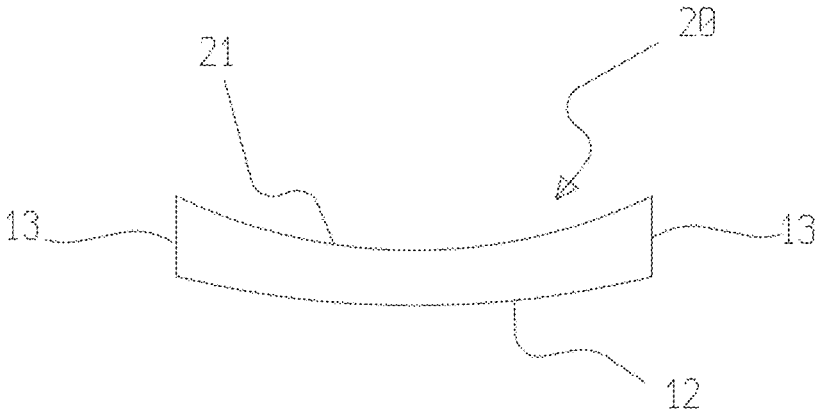
FIG. 2 shows a schematic sectional view of a rigid element, in a preferred embodiment, for the production of a bulletproof structure of the invention.

FIG. 2 shows a schematic sectional view of a preferred embodiment of rigid element, 20, for the realization of a bulletproof structure of the invention. In this embodiment, both main faces of said rigid elements are curved surfaces, the front face 21 is concave and the rear face 12 convex, said rigid elements adhere to the flexible base for a fraction of their convex surface, and the thickness at the edge of the element is between 0.5 and 2 mm greater than the thickness at the center of the element itself. This geometry allows to lighten the rigid elements given their smaller thickness at the center with respect to the rigid element 10, and consequently to decrease the weight of the bulletproof structure as a whole; at the same time, the greater thickness at the edges with respect to the center of the elements of type 20 guarantees the necessary mechanical resistance to the impact of the bullets in this zone, which is a critical characteristic of the known bulletproof structures.

In an even more preferred embodiment, the two main faces, 12 and 21, of a rigid element of type 20 are two portions of spherical caps; in this case, the condition that the thickness at the edge of the element is between 0.5 and 2 mm greater than the thickness at the center of the element itself entails that the radius of curvature of the concave surface 21 is less than that of the convex surface 12. Depending on the lateral dimensions of a rigid element of type 20, the radius of curvature of the concave surface can vary between 30 and 300 mm; the radius of curvature of the convex surface will vary accordingly, to ensure the condition of greater thickness at the edge with respect to the center of the element.

The rigid elements, both of type 10 and of type 20, are produced with the materials that are typically used for this application, i.e. metals or, preferably, ballistic ceramics such as aluminium oxide (alumina), silicon carbide or boron carbide. The production methods for these rigid elements are well known to those skilled in the art, and generally consist in sintering powders of the aforementioned materials, typically at temperatures between 1500 and 2200° C. The advantage of the rigid elements of the invention with respect to those known (for example, those of EP 3805691 A1) is that since the two main surfaces are spherical, during their production the pressure is exerted uniformly in all their points, which ensures the maximum homogeneity of structural and mechanical characteristics of the rigid elements obtained.

In a plan view, the rigid elements of the structures of the invention may have any shape suitable for tessellating a flat surface, i.e. typically triangular, rectangular, preferably square or even more preferably hexagonal shape.

Figure 3:
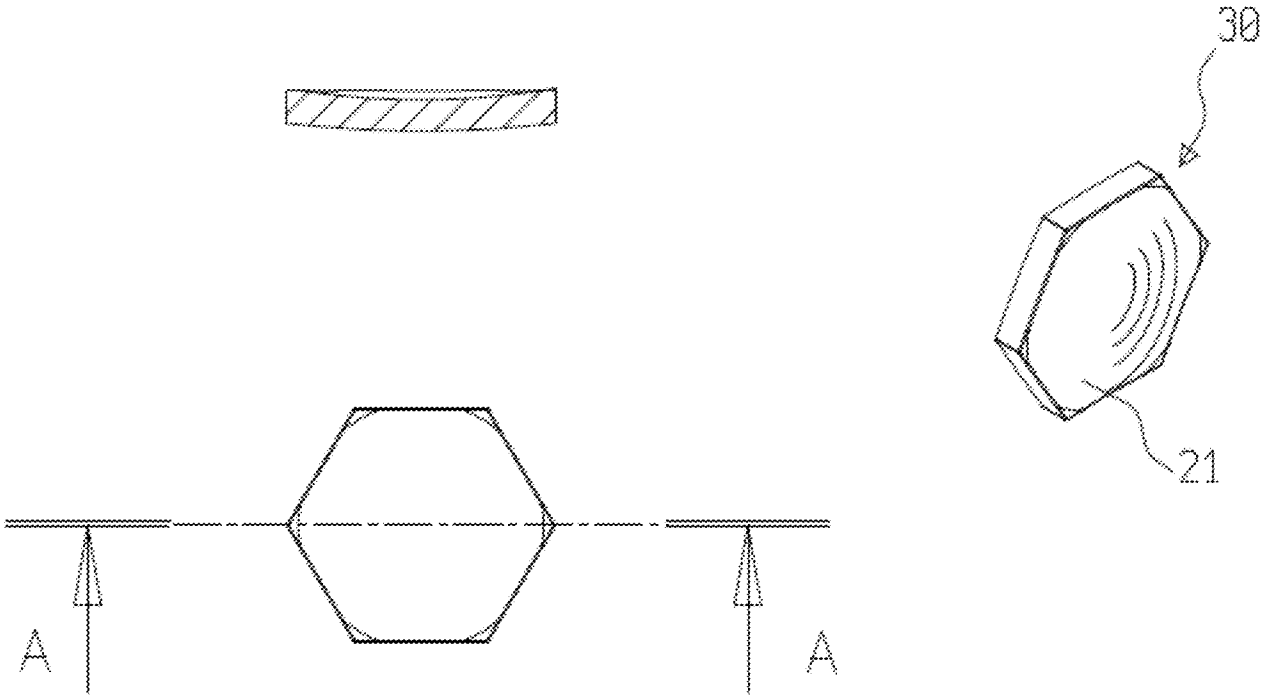
FIG. 3 shows, in plan, sectional and perspective views, a first possible rigid element for the realization of a bulletproof structure of the invention.

FIG. 3 shows, in plan, sectional and perspective views, a rigid element 30 with the preferred hexagonal geometry in plan, and with concave front face 21.

The lateral dimensions of the rigid elements useful for the invention, in any of the possible shapes illustrated above, may vary within wide margins; for the preferred hexagonal shape, the lateral dimensions may vary indicatively between 10 and 50 mm, while the thicknesses typically vary between 2 and 10 mm.

The flexible base is the same as the one of known bulletproof structures. This base is made with the aramid (for example Kevlar®) or ultra-high molecular weight polyethylene (UHMWPE, for example Dyneema®) fibers mentioned above; the fibers can be arranged unidirectionally, variously intertwined or woven, according to methods known to those skilled in the art. The number of layers of fibers can be varied, depending on the degree of protection to be obtained; typically the flexible base has a thickness between about 1 to 5 mm.

The rigid elements are adhered to the base in polymer fibers by gluing, typically with thermoplastic elastomeric resins, for example polyurethane elastomers.

Figure 4:
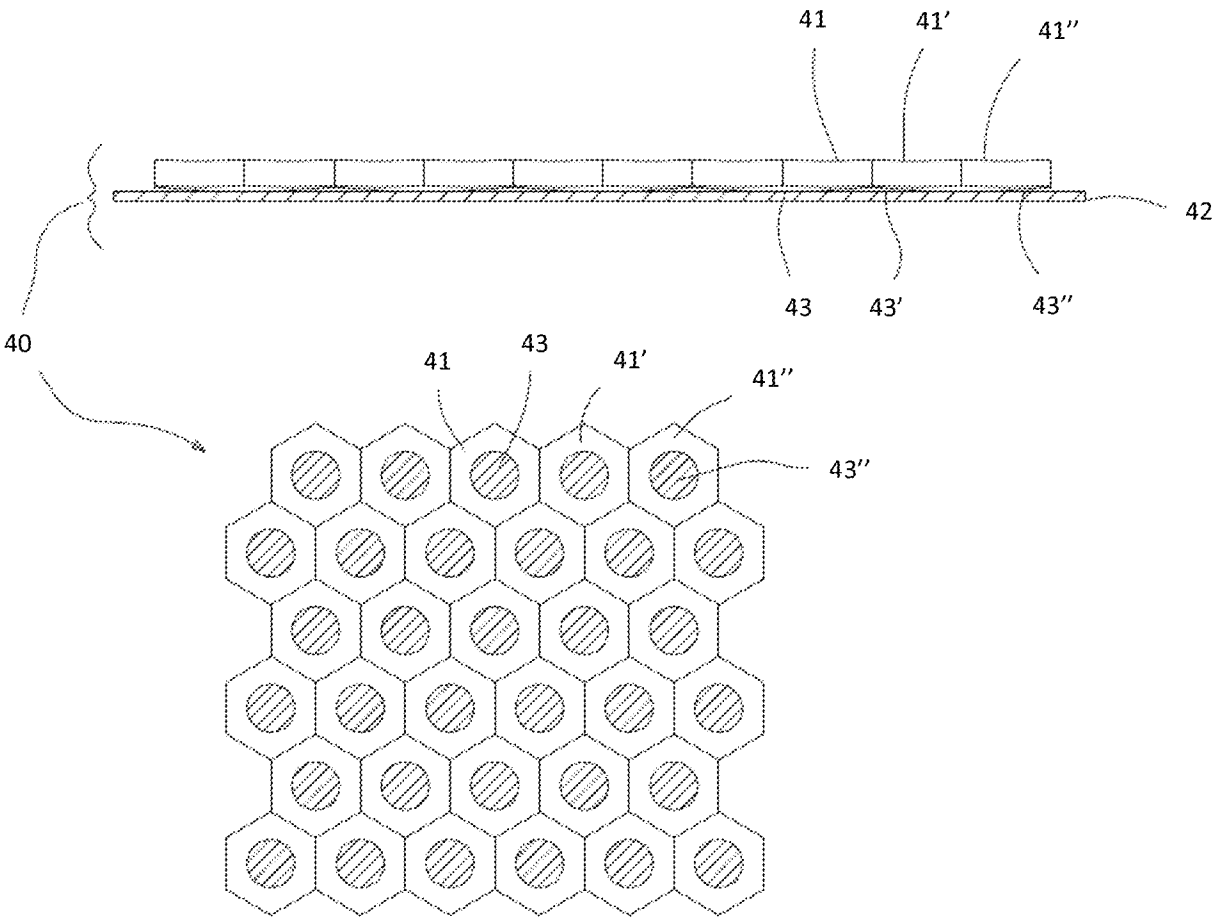
FIG. 4 shows, in a plan and sectional view, a possible bulletproof structure of the invention.

Since the gluing surface is convex, while normally the flexible base is kept in planar arrangement during the production of the structures, virtually the adhesion area would be a single point; however, to favour gluing, during the same and until the glue has solidified, a pressure is exerted on the rigid elements, so that these are partially "pushed" inside the base of polymer fibers, so that the gluing zone extends to a spherical cap. This condition is schematically represented in FIG. 4: in the upper part of the figure there is shown a sectional view of a structure 40 made of a series of rigid elements of the invention, 41, 41', 41", . . . , adhering to the flexible base 42 in the zones 43, 43', 43", . . . ; in the lower part of the figure there is instead shown a plan view of the structure 40, in which the rigid elements 41, 41', 41", . . . have the preferred hexagonal shape, and the dashed circular central zones represent the areas for gluing 43, 43', 43", . . . to the base 42. As can be seen in this last figure, the gluing zones are relatively far apart, and the base 42 is free to bend and curve between two contiguous gluing zones, while in the gluing-free zones the rigid elements 41, 41', 41", . . . , which are not constrained to each other, will be able to rise with respect to the base 42 while the latter is being bent. The width of the central zones 43, 43', 43", . . . depends on the radius of curvature of the convex surface, and therefore on the degree of flexibility desired in the final structure: a smaller radius of curvature will correspond to a smaller width of the zones 43, 43', 43", . . . , and therefore a greater flexibility of the final bulletproof structure; it is therefore possible with the present invention to obtain bulletproof structures with sufficient flexibility to adapt to the shapes of the body.

The bulletproof structure is then completed with an additional layer of textile material, not necessarily of ballistic type, arranged on the front part of the rigid elements, for aesthetic reasons and to favour the maintenance of the correct positioning of said elements.

The invention claimed is:

1. A bulletproof structure comprising:

a flexible base including intertwined or unidirectional ballistic fibers on which rigid metallic or ceramic elements are adhered adjacent to each other, wherein a face of said elements adhering to the fibers is a convex surface;

the rigid elements adhere to the flexible base for a fraction of said convex surface;

in a plan view the rigid elements have a polygonal or pseudo-polygonal shape, such that there are no voids between sides of two abutting rigid elements;

a face of said rigid elements opposite to said convex surface is a concave surface having a radius of curvature that is lower than a radius of curvature of the convex surface so that a thickness at an edge of the element is between 0.5 and 2 mm greater than a thickness at a center of the same element.

2. The bulletproof structure according to claim 1, wherein the radius of curvature of the concave surface is between 30 and 300 mm.

3. The bulletproof structure according to claim 1, wherein the radius of curvature of the convex surface is between 40 and 350 mm.

4. The bulletproof structure according to claim 3, wherein the radius of curvature of the convex surface is between 80 and 250 mm.

5. The bulletproof structure according to claim 4, wherein the radius of curvature of the convex surface is between 100 and 180 mm.

6. The bulletproof protective structure according to claim 1 in which, in a top view, said rigid elements have a triangular, rectangular, square or hexagonal shape.

7. The bulletproof protective structure according to claim 1, in which said rigid elements have lateral dimensions between 10 and 50 mm and thickness between 2 and 10 mm.

8. The bulletproof protective structure according to claim 1, in which the flexible base is made of aramid or ultra-high molecular weight polyethylene (UHMWPE) fibers and has a thickness between 1 and 5 mm.

9. The bulletproof protective structure according to claim 1, in which the rigid elements are made of aluminum oxide, silicon carbide or boron carbide.

10. A bulletproof structure comprising:

a flexible base including intertwined or unidirectional ballistic fibers on which rigid metallic or ceramic elements are adhered adjacent to each other, wherein a face of said elements adhering to the fibers is a convex surface;

the rigid elements adhere to the flexible base for a fraction of said convex surface;

in a plan view the rigid elements have a polygonal or pseudo-polygonal shape, such that there are no voids between sides of two abutting rigid elements; and the flexible base is made of aramid or ultra-high molecular weight polyethylene (UHMWPE) fibers and has a thickness between 1 and 5 mm.

11. The bulletproof structure according to claim 10, wherein the face of said rigid elements opposite to said convex face is flat.

12. The bulletproof structure according to claim 10, wherein a face of said rigid elements opposite to said convex face is a concave surface, and a radius of curvature of the concave surface is lower than the radius of curvature of the convex surface, so that a thickness at an edge of the element is between 0.5 and 2 mm greater than a thickness at a center of the same element.

13. The bulletproof structure according to claim 12, wherein the radius of curvature of the concave surface is between 30 and 300 mm.

14. The bulletproof structure according to claim 10, wherein the radius of curvature of the convex surface is between 40 and 350 mm.

15. The bulletproof structure according to claim 14, wherein the radius of curvature of the convex surface is between 80 and 250 mm.

16. The bulletproof structure according to claim 15, wherein the radius of curvature of the convex surface is between 100 and 180 mm.

17. The bulletproof protective structure according to claim 10 in which, in a top view, said rigid elements have a triangular, rectangular, square or hexagonal shape.

18. The bulletproof protective structure according to claim 10, in which said rigid elements have lateral dimensions between 10 and 50 mm and thickness between 2 and 10 mm.

19. The bulletproof protective structure according to claim 10, in which the rigid elements are made of aluminum oxide, silicon carbide or boron carbide.

* * * * *